United States Patent [19]

Ueda et al.

[11] Patent Number: 4,756,918

[45] Date of Patent: Jul. 12, 1988

[54] METHOD FOR PROCESSING SILVER HALIDE COLOR PHOTOGRAPHIC MATERIALS INCLUDING A COUNTER-CURRENT BLEACHING-FIXATION SYSTEM

[75] Inventors: Shinji Ueda; Akira Abe; Junya Nakajima, all of Kanagawa, Japan

[73] Assignee: Fuji Photo Film Co., Ltd., Ashigara, Japan

[21] Appl. No.: 920,289

[22] Filed: Oct. 17, 1986

[30] Foreign Application Priority Data

Oct. 18, 1985 [JP] Japan ..... 60-232473

[51] Int. Cl.[4] ..... G03C 7/00; G03C 5/38; G03C 5/24; G03C 5/44

[52] U.S. Cl. ..... 430/393; 430/400; 430/430; 430/445; 430/460; 430/462

[58] Field of Search ..... 430/393, 430, 445, 460, 430/462, 400

[56] References Cited

U.S. PATENT DOCUMENTS 3,820,997 6/1974 Shirasu et al. ..... 430/393
3,879,203 4/1975 Schranz et al. ..... 430/393
4,524,129 6/1985 Kishimoto et al. ..... 430/393
4,621,047 11/1986 Kishimoto et al. ..... 430/393

*Primary Examiner*—Mukund J. Shah
*Attorney, Agent, or Firm*—Burns, Doane, Swecker & Mathis

[57] ABSTRACT

The present invention, relates to a method for the bleaching-fixation processing of silver halide color photographic materials. The present invention provides for sufficient desilvering in a short period of time without deterioration of the photographic characteristic of the materials as processed while minimizing the amount of replenisher which is used. Accordingly, the present invention is a method for the processing of silver halide color photographic materials wherein, after the color-development, the material is processed by bleaching-fixation with at least two continuous bleaching-fixation baths to which a replenisher is fed in a countercurrent system, wherein the total bleaching-fixation processing time in the bleaching-fixation step is to be 0.37 minutes or more per $g/m^2$ of the silver amount coated on the material and wherein the processing time in the first bleaching-fixation bath is to be 45% or less of the total bleaching-fixation processing time.

15 Claims, No Drawings

METHOD FOR PROCESSING SILVER HALIDE COLOR PHOTOGRAPHIC MATERIALS INCLUDING A COUNTER-CURRENT BLEACHING-FIXATION SYSTEM

FIELD OF THE INVENTION

The present invention relates to a method for processing silver halide color photographic materials. In particular, the present invention relates to a method for the bleaching-fixation processing of photographic materials which provides sufficient desilvering of the materials in a short period of time without deterioration of the photographic characteristic of the materials as processed while limiting the amount of replenisher which is used in the processing step.

BACKGROUND OF THE INVENTION

The principal steps in the processing of color photographic materials are a color-development step followed by a desilvering step. In the color-development step, the exposed silver halide is reduced with a color-developing agent to form silver, while the oxidized color-developing agent is reacted with a coupler to form color images. In the desilvering step, the silver formed in the color-development step is oxidized with an oxidizing agent (which is generally called a fixing agent). After the desilvering step, only color images are formed in the color photographic materials.

The desilvering step may be carried out by the use of both a bleaching bath containing a bleaching agent and a fixation bath containing a fixing agent. Alternatively, the step may be carried out by the use of a bleaching-fixation bath containing both a bleaching agent and a fixing agent. Also, desilvering may be accomplished by the use of both a bleaching bath and a bleaching-fixation bath.

Regarding the use of only a bleaching-fixation bath, a method is known where two or more bleaching-fixation baths are provided and a replenisher is fed to the final bath. The overflow solution from the final bath is introduced into the previous bath in order to create a countercurrent system thereby reducing the amount of the replenisher which is used. For example, Japanese Patent Application (OPI) No. 11131/74 (corresponding to OLS-2217570) describes a method for processing photographic materials with two or more continuous bleaching-fixation baths where a recovered solution from the bleaching-fixation bath is replenished in a countercurrent system. (*The term "OPI" as used herein means an "unexamined and published application"*.) Although the amount of waste from the bleaching-fixation solution may be reduced by this method, the desilvering had been found to be insufficient especially when color photographic materials with high iodine content are processed. This is because when photographic materials having high iodine content are processed, the replenisher which is recovered has a higher halogen ion concentration than a standard replenisher. In Japanese Patent Application (OPI) No. 105148/83 a method is described for improving the desilvering efficiency of photographic materials. In this method at least two bleaching-fixation baths are provided and the fixing agent component is primarily replenished in the bleaching-fixation bath positioned nearer to the color-development bath and the bleaching agent component is primarily replenished to the bleaching-fixation bath positioned nearer to the rinsing bath. This process is also carried out in a countercurrent system. In this method, however, since two or more types of replenishers are fed to two or more processing tanks, the operation is complicated and troublesome. Furthermore, desilvering is not always adequate.

The object of the present invention, therefore, is to provide a method for the bleaching-fixation processing of silver halide color photographic materials wherein rapid and sufficient desilvering is achieved while requiring only a small amount of replenisher and maintaining simplicity in operation.

The present inventors have found that when photographic materials are processed in a countercurrent system wherein at least two bleaching-fixation baths are used and a replenisher is fed into the final bath and the overflow solution is introduced into the previous bath, the first bath or the bleaching-fixation bath which is nearest to the color-development bath becomes less active because of the accumulation of color-developer, silver and iodide ion. Consequently, when photographic materials are processed in such a less active bath for a long period of time, not only is the time required desilvering longer but also desilvering is insufficient. The present invention, therefore, is based upon this discovery.

SUMMARY OF THE INVENTION

Accordingly, the present invention provides for a method for processing silver halide color photographic materials wherein the materials, after color-development, are processed by bleaching-fixation with at least two continuous bleaching-fixation baths to which a replenisher is fed in a countercurrent manner. In the method of the present invention the total bleaching-fixation processing time in the bleaching-fixation step is at least 0.37 minute per g/m$^2$ of the silver amount as coated on the material and the processing time in the first bleaching-fixation bath is not more than 45% of the total bleaching-fixation processing time.

DETAILED DESCRIPTION OF THE INVENTION

If the total bleaching-fixation processing time is less than 0.37 minutes per g of the coated silver amount, or if the processing time in the first bleaching-fixation bath exceeds 45% of the total bleaching-fixation processing time, it has been found that desilvering will be inadequate. Therefore, in the method of the present invention, the processing time in the first bleaching-fixation bath is necessarily not more than 45% of the total bleaching-fixation processing time, and is preferably 10 to 40% thereof.

In the method of the present invention, the total bleaching-fixation processing time is preferably 0.5 to 10 minutes, and when a bleaching-accelerator selected from compounds of the general formulae (I) through (IX) as discussed hereunder is used, the time is more preferably 0.5 to 8 minutes.

In the method of the present invention, the bleaching-fixation replenisher is fed to the final bath while the overflow solution is introduced into the previous bath. Accordingly, the bleaching-fixation activity in the bleaching-fixation bath which is nearest to the color-developer bath is generally the lowest. If the photographic materials are processed in a bleaching-fixation bath of such low activity for a long period of time, the accumulation of un-bleached silver will occur. Accordingly, in the method of the present invention, the processing time in the first bleaching-fixation bath is shortened so that the formation of such silver is minimized thus, substantially improving desilvering speed and desilvering efficiency.

The bleaching agents which may be used in the bleaching-fixation bath of the present invention are for example, iron(III)-, cobalt(III)-, chromium(VI)-, copper(II)- or the like polyvalent metal compounds (such as ferricyanides), peracids, quinones, nitroso compounds; bichromates; iron(III)- or cobalt(III)-organic complexes (for example, complexes with aminopolycarboxylic acids such as ethylenediaminetetraacetic acid, diethylenetriaminepentaacetic acid or aminopolyphosphonic acids, phosphonocarboxylic acids or organic phosphonic acids), organic acids such as citric acid, tartaric acid or malic acid; persulfates; hydrogen peroxide; and permanganates. In particular, iron(III)-organic complexes and persulfates are especially preferred due to their rapid processability and the reduction in environmental pollution. Typical examples of the aminopolycarboxylic acids and aminopolyphosphonic acids and salts thereof to be usable for the formation of the iron(III)-organic complexes are given below.

Ethylenediaminetetraacetic acid,
Diethylenetriaminepentaacetic acid,
Ethylenediamine-N-(β-hydroxyethyl)-N,N',N'-triacetic acid,
1,2-diaminopropanetetraacetic acid,
Triethylenetetraminehexaacetic acid,
Propylenediaminetetraacetic acid,
Nitrilotriacetic acid,
Nitrilotripropionic acid,
Cyclohexanediaminetetraacetic acid,
1,3-diamino-2-propanoltetraacetic acid,
Methyliminodiacetic acid,
Iminodiacetic acid,
Hydroxyliminodiacetic acid,
Dihydroxyethylglycine-ethylether-diaminetetraacetic acid,
Glycolether-diaminetetraacetic acid,
Ethylenediaminetetrapropionic acid,
Ethylenediaminedipropionic acid,
Phenylenediaminetetraacetic acid,
2-phosphonobutane-1,2,4-triacetic acid,
1,3-diaminopropanol-N,N,N',N-'tetramethylenephosphonic acid,
Ethylenediamine-N,N,N',N'-tetramethylenephosphonic acid,
1,3-propylenediamine-N,N,N',N'-tetramethylenephosphonic acid,
1-hydroxyethylidene-1,1'-diphosphonic acid.

In particular, iron(III) complexes of ethylenediaminetetraacetic acid, diethylenetriaminepentaacetic acid, cyclohexanediaminetetraacetic acid, 1,2-diaminopropanetetraacetic acid or methyliminodiacetic acid are especially preferred among them, because of their high bleaching effect.

Regarding the iron(III)-complexes, one or more ready-made iron(III)-complexes may be used. Alternatively, an iron(III)-salt (such as ferric sulfate, ferric chloride, ferric nitrate, ammonium ferric sulfate or ferric phosphate) and a chelating agent (such as aminopolycarboxylic acid, aminopolyphosphonic acid or phosphonocarboxylic acid) may be reacted in a solution to form a ferric ion-complex when the complexes one formed in a solution, two or more types of the ferric salts and/or the chelating agents may be used. In both the use of ready-made complexes or the formation of complexes, a stoichiometrical amount or more of the chelating agent may be used. In addition, the complexes may contain metal ions other than the iron ion (such as cobalt or copper ion), a complex thereof or hydrogen peroxide.

The persulfates which are usable in the present invention are alkali metal persulfates such as potassium sulfate, sodium sulfate or ammonium sulfate.

The bleaching-fixation solutions which are usable in the present invention optionally contain a re-halogenating agent. For example, bromides (such as potassium bromide, sodium bromide and ammonium bromide), chlorides (such as potassium chloride, sodium chloride and ammonium chloride) or iodides (such as ammonium chloride) may be used. In addition, the bleaching-fixation solutions may further contain, if necessary, one or more inorganic acids, organic acids or alkali metal or ammonium salts thereof, as pH-buffers. Examples of pH buffers include boric acid, borax, sodium metaborate, acetic acid, sodium acetate, sodium carbonate, potassium carbonate, phosphorus acid, phosphoric acid, sodium phosphate, citric acid, sodium citrate or tartaric acid. The solutions may also include an antiseptic such as ammonium nitrate or guanidine.

The amount of the bleaching agent to be contained in the bleaching-fixation bath is suitably 0.1 to 2 moles per liter of bleaching-fixation bath solution. The pH range of the solution is preferably 0.5 to 9.0 in case of ferric complexes, and in particular, the pH range is preferably 4.0 to 8.5 in case of ferric complexes with aminopolycarboxylic acids, aminopolyphosphonic acids, phosphonocarboxylic acids or organic phosphonic acids. In case of persulfates, the concentration is preferably 0.1 to 2 moles liter, and the pH range is preferably 1 to 8.5.

The fixing agents which are usable in the method of the present invention may be known fixing agents or water-soluble silver halide solubilizers, for example, thiosulfates such as sodium thiosulfate and ammonium thiosulfate, thiocyanates such as sodium thiocyanate and ammonium thiocyanate, and thioether compounds and thioureas such as ethylene-bisthioglycolic acid and 3,6-dithia-1,8-octanediol. These fixing agents may be used singly or in the form of a mixture of two or more of them. The concentration of the fixing agent in the solution is preferably 0.2 to 4 moles/liter.

The bleaching-fixation bath to be used in the method of the present invention may contain, in addition to the aforesaid additives, a preservative selected from sulfites such as sodium sulfite, potassium sulfite or ammonium sulfite, bisulfites, hydroxylamines, hydrazines and aldehyde compound/bisulfite adducts such as acetaldehyde/sodium bisulfite adduct. In addition, the solutions may further contain various kinds of fluorescent whitening agents, anti-foaming agents, surfactants or organic solvents such as polyvinylpyrrolidone or methanol.

The bleaching-fixation bath and/or the previous bath (e.g., an upstream bleaching-fixation bath, a color development bath, a pre-bath for treating the photographic material with only a bleaching accelerator, etc., preferably additional baths provided between the color development bath and the bleaching-fixation bath) may optionally contain a bleaching-accelerator, if desired. That is, a silver halide color photographic material may be contacted, subsequent to color development and prior to or simultaneously with the contact with a bleaching agent, with a bleach-accelerating amount of a bleach-accelerator. Examples of suitable bleaching-accelerators are given hereinbelow.

The bleaching-accelerators which may be incorporated in the bleaching-fixation bath and the previous bath are those having a bleaching-acceleration effect and selected from compounds with a mercapto group or a disulfide bond, thiazolidine derivatives, thiourea derivatives and isothiourea derivatives. Especially usable bleaching-accelerators are those represented by the following formulae (I) through (IX):

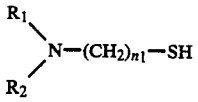

(I)

In this formula, $R_1$ and $R_2$ may be same or different and each represent a hydrogen atom, a substituted or unsubstituted lower alkyl group (preferably having 1–5 carbon atoms, especially a methyl, ethyl or propyl group) or an acyl group (preferably having 1–3 carbon atoms, such as acetyl group or propionyl group); and $n_1$ is an integer of 1 to 3.

$R_1$ and $R_2$ may be bonded to each other to form a 5- or 6-membered ring containing O or N as a hetero atom.

In particular, $R_1$ and $R_2$ each are preferably an unsubstituted or substituted lower alkyl group.

Substituents on $R_1$ and $R_2$ are, for example, a hydroxyl group, a carboxyl group, a sulfo group or an amino group.

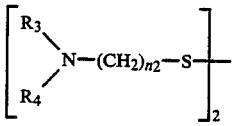

(II)

In this formula (II), $R_3$ and $R_4$ have the same meanings as $R_1$ and $R_2$ in the formula (I); and $n_2$ is an integer of 1 to 3.

$R_3$ and $R_4$ may be bonded to each other to form a ring.

$R_3$ and $R_4$ each are preferably an unsubstituted or substituted lower alkyl group.

Substituents on $R_3$ and $R_4$ are, for example, a hydroxyl group, a carboxyl group, a sulfo group or an amino group.

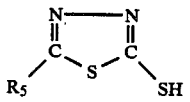

(III)

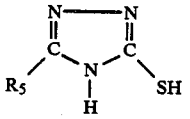

(IV)

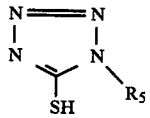

(V)

In these formulae, $R_5$ represents a hydrogen atom, a halogen atom (such as chlorine atom or bromine atom), an amino group, a substituted or unsubstituted lower alkyl group (preferably having 1–5 carbon atoms, especially a methyl, ethyl or propyl group) or an alkyl group-containing amino group having 1 to 3 carbon atoms in each alkyl moiety (such as methylamino, ethylamino, dimethylamino or diethylamino group). hydroxyl group, a carboxyl group, a sulfo group or an amino group.

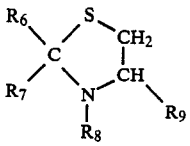

(VI)

In this formula (VI), $R_6$ and $R_7$ may be same or different and each are a hydrogen atom, an optionally substituted alkyl group (preferably a lower alkyl group having 1 to 4 carbon atoms such as a methyl, ethyl or propyl group), an optionally substituted phenyl group or an optionally substituted 5- or 6-membered heterocyclic group (more precisely, a heterocyclic group having at least one or more hetero atoms such as a nitrogen atom, an oxygen atom and/or a sulfur atom, such as a residue of a pyridine ring, a thiophene ring, a thiazolidine ring, a benzoxazole ring, a benzotriazole ring, a thiazole ring, an imidazole ring).

$R_8$ represents a hydrogen atom or an optionally substituted lower alkyl group (preferably having 1–3 carbon atoms, such as a methyl group or an ethyl group).

Substituents on $R_6$ to $R_8$ may be, for example, a hydroxyl group, a carboxyl group, a sulfo group, an amino group or a lower alkyl group having 1 to 4 carbon atoms.

$R_9$ represents a hydrogen atom or a carboxyl group.

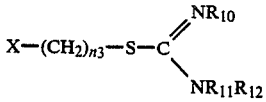

(VII)

In this formula (VII), $R_{10}$, $R_{11}$ and $R_{12}$ may be same or different and each represent a hydrogen atom or a lower alkyl group (preferably having 1–3 carbon atoms, such as a methyl group or an ethyl group); and $n_3$ in an integer of 1 to 4, preferably 1 or 2.

$R_{10}$ and $R_{11}$ or $R_{12}$ may be bonded to each other to form a 5- or 6-membered ring.

X represents an amino group optionally having substituent(s) (for example, a lower alkyl group having 1 to 4 carbon atoms such as methyl group or an alkoxyalkyl group having 2 to 8 carbon atoms such as acetoxymethyl group) or an amino group, a sulfonic acid group or a carboxyl group.

$R_{10}$ to $R_{12}$ preferably represent hydrogen atoms, methyl or ethyl groups. X is preferably an amino group or a dialkylamino group.

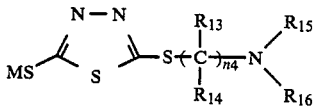

(VIII)

In this formula (VIII), $R_{13}$ and $R_{14}$ each represent a hydrogen atom, a hydroxyl group, a substituted or unsubstituted amino group, a carboxyl group, a sulfo group or a substituted or unsubstituted alkyl group having 1 to 4 carbon atoms. $R_{15}$ and $R_{16}$ each represent a hydrogen atom, a substituted or unsubstituted alkyl group having 1 to 3 carbon atoms or a substituted or unsubstituted acyl group having 1 to 10 carbon atoms. $R_{15}$ and $R_{16}$ may be bonded to each other to form a 5- or 6-membered ring. M represents a hydrogen atom, an alkali metal atom or an ammonium group and $n_4$ is an integer of from 2 to 5.

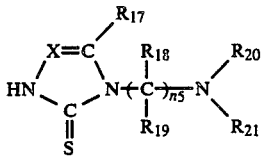

(IX)

In this formula (IX), X represents N or C—R, and $n_5$ is an integer of from 0 to 5. R, $R_{17}$, $R_{18}$ and $R_{19}$ each represent a hydrogen atom, a halogen atom, an amino group, a hydroxyl group, a carboxyl group, a sulfo group or a substituted or unsubstituted alkyl group having 1 to 5 carbon atoms. $R_{20}$ and $R_{21}$ each represent a hydrogen atom a substituted or unsubstituted alkyl group having 1 to 4 carbon atoms or acyl group having 1 to 4 carbon atoms. $R_{20}$ and $R_{21}$ may be bonded to each other to form a 5- or 6-membered ring with the proviso that both $R_{20}$ and $R_{21}$ are not both hydrogen atoms.

Preferred examples of the compounds represented by the formulae (I) through (IX) are given below.

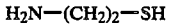

(I)-(1)

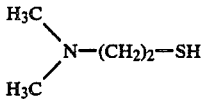

(I)-(2)

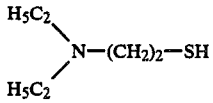

(I)-(3)

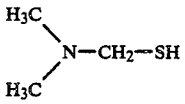

(I)-(4)

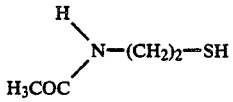

(I)-(5)

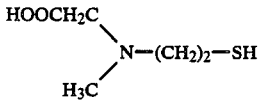

(I)-(6)

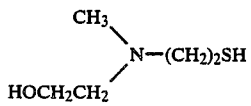

(I)-(7)

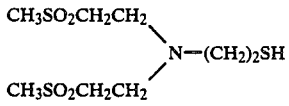

(I)-(8)

-continued

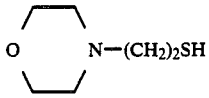

(I)-(9)

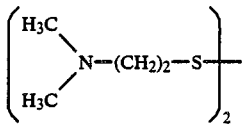

(II)-(1)

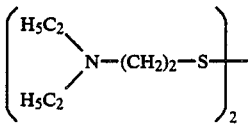

(II)-(2)

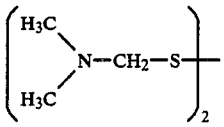

(II)-(3)

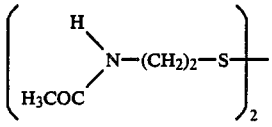

(II)-(4)

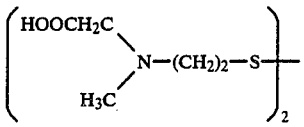

(II)-(5)

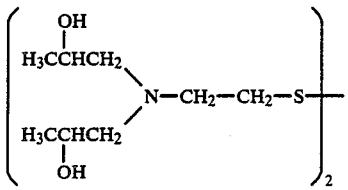

(II)-(6)

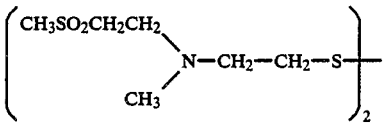

(II)-(7)

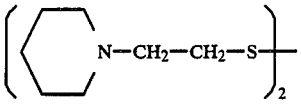

(II)-(8)

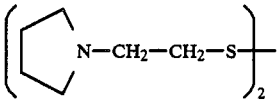

(II)-(9)

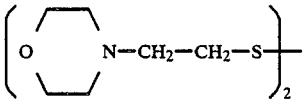

(II)-(10)

-continued
(III)-(1)
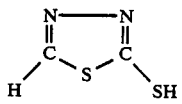
(III)-(2)
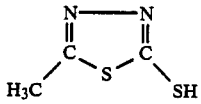
(III)-(3)
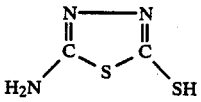
(III)-(4)
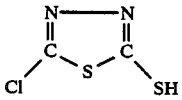
(IV)-(1)
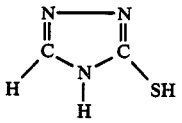
(IV)-(2)
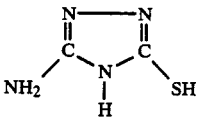
(IV)-(3)
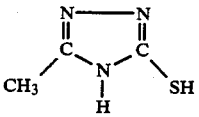
(V)-(1)
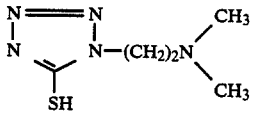
(V)-(2)
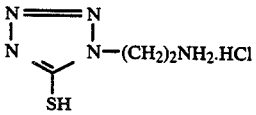
(VI)-(1)
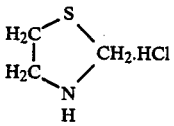
(VI)-(2)
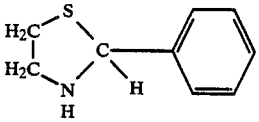
(VI)-(3)
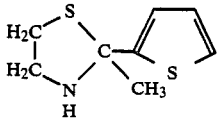
-continued
(VII)-(1)
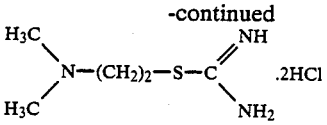
(VII)-(2)
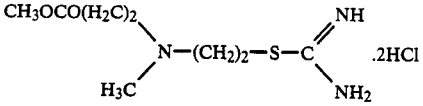
(VII)-(3)
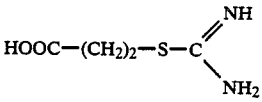
(VII)-(4)
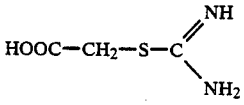
(VII)-(5)
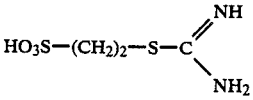
(VII)-(6)
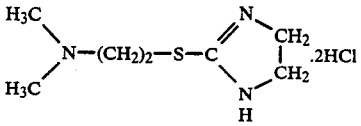
(VIII)-(1)
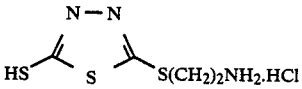
(VIII)-(2)
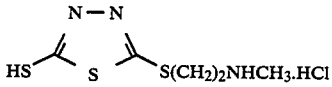
(VIII)-(3)
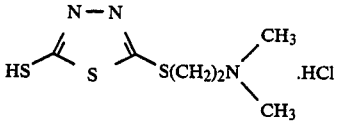
(IX)-(1)
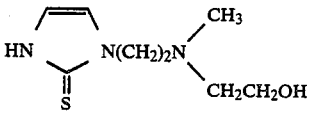
(IX)-(2)
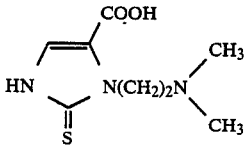
(IX)-(3)
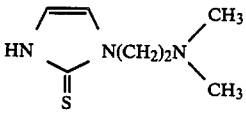
(IX)-(4)
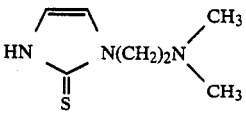

The above-mentioned compounds may be synthesized by means of known methods. In particular, the compounds of the formula (I) may be obtained in accordance with U.S. Pat. No. 4,285,984, "Helv. Chim. Acta." (by G. Schwarzenbach et al.) 38, 1147 (1955) and "J. Am. Chem. Soc." (by R.O. Clinton et al.), 70, 950 (1948). Those compounds of formula (II) may be obtained in accordance with Japanese Patent Application (OPI) No. 95630/78. Those compounds of formulae (III) and (IV) may be obtained in accordance with Japanese Patent Application (OPI) No. 52534/79. Those compounds of formula (V) may be obtained in accordance with Japanese Patent Application (OPI) No. 68568/76, No. 70763/76 and No. 50169/78. The compounds of formula (VI) may be obtained in accordance with Japanese Patent Publication No. 9854/78 and Japanese Patent Application No. 88938/83. The compounds of formula (VII) may be obtained in accordance with Japanese Patent Application (OPI) No. 94927/78. The compounds of formula (VIII) may easily be obtained by alkylation of 2,5-dimercapto-1,3,4-thiadiazoles in accordance with "Advances in Heterocyclic Chemistry", 9, 165–209 (1968) and those of formula (IX) may be obtained in accordance with "Ber." (by A. Whole, W. Marckwald), 22, 568 (1889), "Ber" (by M. Freund), 29, 2483 (1896), "J. Chem. Soc." (by A. P. T. Easson et al.), 1932, 1896 and "J. Am. Chem. Soc." (by R. G. Jones, et al.), 71, 4000 (1949).

The bleach-accelerator which can be used preferably in the present invention may be a bleach-accelerator which is image-wise released upon development of silver halide from a bleach-accelerator-releasing coupler as described in Japanese Patent Application (OPI) No. 201247/85. Preferably, those couplers can be used in which the sulfur atom of the mercapto group in the bleach-accelerator is attached directly or through a timing group to the coupling active carbon atom of the coupler.

The amount of the aforesaid mercapto groupor disulfide bond-containing compounds, thiazoline derivatives or isothiourea derivatives to be added to the bleaching-fixation bath or to the previous bath varies depending upon the kind of the photographic materials to be processed, the processing temperature and the time required for the desired processing. In general, the amount is suitably $1\times10^{-5}$ to $1\times10^{-1}$ mole/liter preferably $1\times10^{-4}$ to $5\times10^{-2}$ mole/liter, of the processing solution.

For the addition of these compounds to the processing solution, the compounds may be previously dissolved in water, an alkali, an organic acid, an organic solvent or the like and then the resulting solution added to the processing solution. Alternatively, a powder of the compound may be directly added to the bleaching-fixation solution without any negative influence on the bleaching-acceleratability of the compound. In the photographic emulsion layers of the color photographic materials to be processed in accordance with the method of the present invention, any of the silver halides such as silver bromide, silver iodobromide, silver iodochlorobromide, silver chlorobromide and silver chloride may be used.

The preferred silver halides are silver iodobromide or silver iodochlorobromide containing 30 mole % or less silver iodide. The especially preferred silver halide is silver iodobromide containing 2 mole % to 25 mole % of silver iodide.

The shape of the silver halide particles in the photographic emulsions is not specifically limitative. The particles may be so-called regular particles having a regular crystalline form such as a cubic, octahedral or tetradecahedral crystal form, irregular particles having a spherical or the like irregular crystal form, or those having a crystal defect such as a twin plane or composite crystalline particles with plural crystalline forms.

Regarding the particle size of the silver halide particles, the particles may be fine particles having a particle size of $0.1\mu$ or less or large particles having a projected area diameter of up to $10\mu$. The particles may comprise a monodispersed emulsion having a narrow particle size distribution or may comprise a polydispersed emulsion having a broad particle size distribution.

The photographic emulsions used in the present invention may be obtained in a conventional manner, for example, as described in "Chimie et Physique Photographique" (written by P. Glafkides and published by Paul Montel, 1967), "Photographic Emulsion Chemistry" (written by G. F. Duffin and published by Focal Press, 1966) and "Making and Coating Photographic Emulsion" (written by V. L. Zelikman, et al. and published by Focal Press, 1964). For instance, any acidic, neutral or ammonia method may be used to form the emulsion. Furthermore, the reaction of a soluble silver salt and a soluble halogen salt, a single-jet method, a double-jet method or a combination thereof all may be used. In addition, a method for the formation of silver halide particles in the presence of an excess of silver ion (which is a so-called reverse admixture method) may also be utilized. A so-called controlled double-jet method where the pAg value is kept constant in the liquid phase in which the silver halide is formed, may also be used as one embodiment of the simultaneous admixture method. By using this method, an emulsion of silver halide grains having a nearly regular crystalline form and having a nearly uniform grain size distribution, may be obtained.

Two or more kinds of silver halide emulsions which were seprately prepared may be blended and used in the method of the present invention.

The aforesaid silver halide emulsions comprising regular particles may be obtained by properly controlling the pAg value and the pH value in the formation of the particles. The details of such a procedure are described in "Photographic Science and Engineering", Vol. 6, pp. 159–165 (1962); "Journal of Photographic Science", Vol. 12, pp. 242–251 (1964); U.S. Pat. No. 3,655,394 and British Pat. No. 1,413,748.

The details on the monodispersed emulsions are described in Japanese Patent Application (OPI) Nos. 8600/73, 39027/76, 83097/76, 137133/78, 48521/79, 99419/79, 37635/83 and 49938/83, Japanese Patent Publication No. 11386/72, U.S. Pat. No. 3,655,394 and British Pat. No. 1,413,748.

Further, tabular particles having an aspect ratio of 5 or more may also be used in the present invention. The tabular particles may easily be prepared in accordance with various methods, for example, as described in Cleve's "Photography Theory and Practice" (1930), page 131; Gutoff's "Photographic Science and Engineering", Vol. 14, pp. 248–257 (1970); U.S. Pat. Nos. 4,434,226, 4,414,310 and 4,434,048 and British Pat. No. 2,112,157. As described in U.S. Pat. No. 4,434,226, the use of the tabular particles is particularly advantageous because they have been found to be effective for the intensification of the color-sensitization efficiency of the sensitizer dyes, which is described in detail in the aforesaid U.S. Pat. No. 4,434,226.

The crystalline structure may be uniform. Otherwise, the particles may comprise different inner and outer halogen compositions or may have laminal structures. These types of emulsion particles are illustrated in British Pat. No. 1,027,146, U.S. Pat. No. 3,505,068, U.S. Pat. No. 4,444,877 and Japanese Patent Application (OPI) No. 143331/85. The particles may have an epitaxial bond-structure with different halogen compositions or may have composite structures with compounds other than silver halides such as silver rhodanide or lead oxide. These emulsion particles are illustrated in U.S. Pat. Nos. 4,094,684, 4,142,900 and 4,459,353; British Pat. No. 2,038,792; U.S. Pat. Nos. 4,349,622, 4,395,478, 4,433,501, 4,463,087, 3,656,962 and 3,852,067; and Japanese Patent Application (OPI) No. 162540/84.

A mixture comprising particles of different crystalline forms may be used.

The color photographic materials to be processed in accordance with the method of the present invention may contain various kinds of color couplers. Typical examples of such couplers are cyan dye-, magenta dye- and yellow dye-forming couplers as described in the patent specifications which are referred to in Research Disclosure No. 17643 (Dec. 1973), VII-D and No. 18717 (Nov. 1979). These couplers are preferably non-diffusive, dimerized or more polymerized, and they may be either tetra-equivalant couplers or di-equivalent. In addition, couplers capable of forming diffusive dyes for the improvement of the graininess as well as DIR-couplers which are capable of releasing development inhibitors during the coupling reaction for the achievement of the edge effect or interlayer effect, may be used in the present invention.

The yellow couplers which are usable in the present invention are preferred to be oxygen atom- or nitrogen atom-removing α-pivaloyl or α-benzoylacetanilide couplers. Especially preferred examples of these di-equivalent couplers are oxygen atom-removing type-yellow couplers as described in U.S. Pat. Nos. 3,408,194, 3,447,928, 3,933,501 and 4,022,620, and nitrogen atom-removing type-yellow couplers as described in U.S. Pat. Nos. 3,973,968, U.S. Pat. No. 4,314,023, Japanese Patent Publication No. 10739/83, Japanese Patent Application (OPI) No. 132926/75, and German Patent (OPI) Nos. 2,219,917, 2,261,361, 2,329,587 and 2,433,812.

The magenta couplers usable in the present invention are preferred to be ballast group-containing hydrophobic indazolone or cyanoacetyl couplers. Preferably they are 5-pyrazolone and pyrazoloazole couplers. Among the 5-pyrazolone couplers, those substituted by an arylamino group or acylamino group in the 3-position are preferred in view of the hue of the colored dyes and the color density thereof. Typical examples of these couplers are described in U.S. Pat. Nos. 2,311,082, 2,343,703, 2,600,788, 2,908,573, 3,062,653, 3,152,896 and 3,936,015. As the removing groups in the di-equivalent 5-pyrazolone-type couplers, nitrogen atom-removing groups as described in U.S. Pat. No. 4,310,619 and arylthio groups as described in U.S. Pat. No. 4,351,897 are especially preferred. Ballast group-containing 5-pyrazolone couplers as described in European Pat. No. 73,646 are preferred, as forming dyes of high color density. Pyrazolazole couplers include pyrazolobenzimidazoles as described in U.S. Pat. No. 3,061,432, preferably pyrazolo[5,1-c][1,2,4]-triazoles as described in U.S. Pat. No. 3,725,067, pyrazolotetrazoles as described in Research Disclosure No. 24220 (Jun. 1984) and Japanese Patent Application (OPI) No. 22552/85, and pyrazolopyrazoles as described in Research Disclosure No. 24230 (Jun. 1984) and Japanese Patent Application OPI No. 43659/85. In particular, imidazo[1,2-b]pyrazoles as described in U.S. Pat. No. 3,500,630 are preferred because of the less yellow side-absorption and the high light-fastness, and pyrazolo-[1,5-b][1,2,4]-triazoles as described in European Pat. No. 119,860A are especially preferred.

Those cyan couplers which are fast to temperature and humidity are preferably used. Typical examples of such cyan coupler include phenol couplers as described in U.S. Pat. No. 3,772,002, 2,5-diacylaminophenol-couplers as described in Japanese Patent Application (OPI) No. 31953/84, No. 166956/84 and No. 24547/85, phenol couplers having 2-phenylureido group and 5-acylamino group as described in U.S. Pat. No. 4,333,999, and naphthol couplers as described in Japanese Patent Application OPI No. 93005/84.

Yellow- or magenta-colored color couplers may be co-used for the purpose of correcting side-absorption in the shorter wavelength range than the main absorption of the colored dyes. These couplers are, in general, emulsified and dispersed in an aqueous medium together with a high boiling point-organic solvent having 16 to 32 carbon atoms, such as a phthalate or phosphate, optionally along with ethyl acetate or other similar organic solvents, and the resulting dispersion is used in the present invention. The standard amount of the color couplers to be used is preferably 0.01 to 0.5 mole in case of the yellow couplers, 0.003 to 0.3 mole in case of the magenta couplers and 0.002 to 0.3 mole in case of the cyan couplers, for each one mole of the light-sensitive silver halide.

The silver halide photograhic emulsions usable in the present invention may be manufactured in a conventional manner, for example, in accordance with the methods as described in Research Disclosure (RD), No. 17643 (Dec. 1978), pp. 22–23, "I. Emulsion Preparation and Types" and RD No. 18716 (Nov. 1976), page 648. In addition, tabular particles as described in U.S. Pat. Nos. 4,434,226 and 4,439,520 and Research Disclosure No. 22534 (Jan. 1983) may also be used in the present invention.

Various kinds of photographic additives which are suitable for use in the present invention are described say the aforesaid Research Disclosure No. 17643, pp. 23–28 and No. 18716, pp. 648–651. The kinds of additives and the relevant parts in the publications are listed below.

| No. | Kinds of Additives | RD 17643 | RD18716 |
|---|---|---|---|
| 1 | Chemical sensitizer | p. 23 | p. 648, light-column |
| 2 | Sensitivity intensifier | | p. 648, light-column |
| 3 | Spectral sensitizer, Supersensitizer | pp. 23–24<br>pp. 23–24 | From p. 648 right-column to p. 649 right-column |
| 4 | Fog-inhibitor, Stabilizer | pp. 24–25 | p. 649, right-column |
| 5 | Light-absorbent, Filter-dye, UV-absorbent | pp. 25–26 | From p. 649, right-column to p. 650, left-column |
| 6 | Stain-inhibitor | p. 25, right-column | p. 650, left to right-column |
| 7 | Hardener | p. 26 | p. 651, |

-continued

| No. | Kinds of Additives | RD 17643 | RD18716 |
|---|---|---|---|
| | | | left-column |
| 8 | Binder | p. 26 | p. 651, left-column |
| 9 | Plasticizer, Lubricant | p. 27 | p. 650, right-column |
| 10 | Coating auxiliary, Surfactant | pp. 26–27 | p. 650, right-column |
| 11 | Anti-static agent | p. 27 | p. 650, right-column |

The primary aromatic amino color developing agents contained in the color developing solution used in the present invention include those which are widely used in various color-photographic processes. These developing agents include aminophenol and p-phenylenediamine derivatives. These compounds are generally used in the form of salts such as hydrochlorides or sulfates rather than the free compounds, because the salts are more stable. The concentation of the compounds is generally in the range of about 0.1 to about 30 g/liter, preferably 1 to about 15 g/liter of the color developer.

Examples of aminophenol developing agents include, for example, o-aminophenol, p-aminophenol, 5-amino-2-hydroxytoluene, 2-amino-3-hydroxy-toluene, 2-hydroxy-3-amino-1,4-dimethylbenzene.

Especially useful primary aromatic amino color-developing agents are N,N-dialkyl-p-phenylendiamine compounds, where the alkyl group and the phenyl group may optionally be substituted or unsubstituted. Particularly preferred compounds among them are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidethyl-3-methyl-4-aminoaniline sulfate, N-ethyl-N-$\beta$-hydroxyethylaminoanline, 4-amino-3-methyl-N,N-diethylaniline, 4-amino-N-(2-methoxyethyl)-N-ethyl-3-methylaniline-p-toluenesulfonate.

The alkaline color developers usable in the present invention may further contain, in addition to the aforesaid primary aromatic amino color developing agents, various additives which are usually added to conventional color developing solutions, for example, alkaline agents such as sodium hydroxide, sodium carbonate or potassium carbonate, alkali metal sulfites, alkali metal bisulfites, alkali metal thiocyanates, alkali metal halides, benzyl alcohol, water-softeners and thickners. The pH value of the color developing solution is usually at least 7, most typically about 9 to about 13.

The method of the present invention may be applied to a color-reversal process. The black-and-white developing solutions used in this progress may be so-called black-and-white primary developers which are generally used in the reversal processing of conventional color photographic materials or may be others which are generally used in the processing of conventional black-and-white photographic materials. The black-and-white developing solutions used in this invention may contain those conventional additives which are generally used in conventional black-and-white developing solutions.

Examples of typical additives are developing agents such as 1-phenyl-3-pyrazolidone, Metol (Registered trademark) and hydroquinones, preservatives such as sulfites, accelerators such as sodium hydroxide, sodium carbonate, potassium carbonate, inorganic or organic inhibitors such as potassium bromide, 2-methylbenzimidazole, methylbenzothiazole, water-softeners such as polyphosphates, and development-inhibitors such as a small amount of iodides or mercapto compounds.

According to the method of the present invention, after being subjected to bleaching-fixation processing, the photographic materials are usually subjected to rinsing and stabilization. However, rinsing may be carried out without stabilization, or, stabilization may be carried out without any substantial rinsing, to simplify the process.

Various known compounds may be added to the processing solution to be used in the rinsing step, for the purpose of preventing the precipitation or for stabilizing the rinsing solution. For example, chelating agents such as inorganic phosphoric acides, aminopolycarboxylic acids, organic phosphonic acids, germicides or fungicides for preventing the generation of various kinds of bacteria, algae or fungi (for example, compounds as described in "J. Antibact. Antifung. Agents", Vol. 11, No. 5, pp. 207–223 (1983) and compounds as described in H. Horiguchi's "Chemistry of Antibacterial and Angifungal Agents"), metal salts such as magnesium salts, aluminium salts, as well as alkali metal salts and ammonium salts, and surfactants for the prevention of drying load or uneveness may be added. Furthermore, compounds as described in West's "Phot. Sci, Eng.", Vol. 6, pp. 344–359 (1965) may also be used. In particular, the addition of chelating agents as well as germicides and fungicides has been found to be effective.

The rinsing step may be carried out in accordance with a multi-stage countercurrent rinsing system with two or more tanks (for example, 2 to 9 tanks) so that the amount of rinsing water may be economized. In place of the rinsing step, a multi-stage counter-current system-stabilization step may be carried out. Such a step is described in Japanese Patent application OPI No. 8543/82. Various kinds of compounds may be added to the stabilization bath for the purpose of stabilizing the formed images. For example, various kinds of buffers may be used for the regulation of the film pH (e.g., within the range of pH 3–8). Such buffers include borates, metaborates, borax, phosphates, carbonates, potassium hydroxide, sodium hydroxide, aqueous ammonia, monocarboxylic acids, dicarboxylic acids and/or polycarboxylic acids, as well as formalin and aldehyde. In addition, additives such as chelating agents (such as inorganic phosphoric acids, monopolycarboxylic acids, organic phosphonic acids, aminopolyphosphonic acids, phosphonocarboxylic acids), germicides (such as thiazoles, isothiazoles, halogenated phenols, sulfanylamides, benzotriazoles), surfactants, fluorescent whitening agents and hardeners may be used either singly or in the form of a mixture of at least two.

To control the pH of the film, film pH-regulators for the photographic materials to be processed may be used. These include various kinds of ammonium salts which may be added to the processing solution, for example, ammonium chloride, ammonium nitrate, ammonium sulfate, ammonium phosphate, ammonium sulfite or ammonium thiosulfate. The addition of the film pH-regulator is preferred for the improvement of the image stability of the materials.

In the processing of the color photographic materials for camera works, the conventional rinsing-stabilization step following the fixation step may be replaced by the aforesaid combination step of stabilization and water-rinsing (process for economization of water to be used). However, if a di-equivalent magenta coupler is used in the photographic materials, the formalin in the stabilization bath may be omitted.

According to the method of the present invention, the processing solutions are generally used at a temperature of from 10° C. to 50° C. The standard processing temperature is 33° C. to 38° C. The processing temperature may be raised to accelerate the processing and to reduce the processing time, or may be lowered to improve the image quality and to intensify the stability of the processing solutions. Furthermore, the photographic materials may be processed with a cobalt-intensifier or a hydrogen preoxide-intensifier as described in German Pat. No. 2,226,770 and U.S. Pat. No. 3,674,499, in order to economize the silver in the materials.

The processing time may be shortened in order to rapidly finish the processing of the photographic materials. However, the time must not be shortened to such an extent that the processing is negatively influenced.

The silver halide color photographic materials of the present invention themselves may include a color-developing agent or a precursor thereof in order to simplify and accelerate the processing of the materials. For such an incorporation, the precursors are preferred since they elevate the stability of the photographic materials. Examples of the developer precursors are indaniline compounds as described in U.S. Pat. No. 3,342,597, Shiff's base compounds as described in U.S. Pat. No. 3,342,599, Research Disclosure No. 14850 (Aug. 1976) and No. 15159 (Nov. 1976), aldol compounds as described in Research Disclosure No. 13924, metal complexes as described in U.S. Pat. No. 3,719,492, and urethane compounds as described in Japanese Patent Application OPI No. 135628/78. In addition, various types of salt precursors as described in Japanese Patent Application (OPI) Nos. 6235/81, 16133/84, 59232/81, 67842/81, 83734/81, 83735/81, 83736/81, 89735/81, 81837/81, 54430/81, 106241/81, 107236/81, 97531/82 and 83565/82 may also be used in the present invention.

The silver halide color photographic materials to be processed in accordance with the method of the present invention may contain various kinds of 1-phenyl-3-pyrazolidones, in order to accelerate the color-development. Typical examples of the compounds are described in Japanese Patent Application (OPI) Nos. 64339/81, 144547/82, 211147/82, 50532/83, 50536/83, 50533/83, 50534/83, 50535/83 and 115438/83.

During continuous processing, a replenisher is fed to each processing solution to prevent variation in the liquid composition of the processing solutions, in order that the photographic materials may be uniformly finished throughout the continuous processing. The amount of the replenisher may be reduced to a half or less than half of the standard amount to lower the manufacturers cost.

The processing baths may optionally include a heater, a temperature sensor, a liquid-level sensor, a circulating pump, a filter, a floating lid and/or a squeezer.

The present invention may be applied to various kinds of color photographic materials. Typical examples are color negative films for general uses or movie works, color reversal films for slides or televisions, color papers, color positive films and color reversal papers. In addition, the present invention may be applied to black-and-white photographic materials attainable by three color coupler-admixture, which are described say in Research Disclosure No. 17123 (July 1978).

In the interest of brevity and conciseness, the contents of the aforementioned numerous patents and articles are hereby incorporated by reference.

The present invention will be explained in greater detail by reference to the following examples. These examples however, are not intended to be interpreted as limiting the scope of the present invention.

EXAMPLE 1

Color negative film HR100 (made by Fuji Photo Film Co.) (coated silver amount: about 5.2g/m$^2$ was imagewise exposed and then continuously processed in accordance with the processing step (A), (B) or (C), which is described below, while a replenisher was fed to each processing bath. In each of the following steps, the processing time for the bleaching-fixation (2) was a full 10 minutes for sufficient desilvering.

TABLE 1

| Processing Bath | Step (A) | Step (B) | Step (C) |
|---|---|---|---|
| Color-development | 3'15" | 3'15" | 3'15" |
| Bleaching-fixation (1) | 4' | 2' | 1' |
| Bleaching-fixation (2) | 10' | 10' | 10' |
| Rinse (1) | 2' | 2' | 2' |
| Rinse (2) | 2' | 2' | 2' |
| Stabilization | 40" | 40" | 40" |

With the exception of the processing time, each processing step and the composition of each processing solution were the same in all of the steps (A), (B) and (C) and were as follows:

TABLE 2

| Processing Bath | Amount of Bath | Temperature | Amount of Replenisher (ml/film) |
|---|---|---|---|
| Color-development | 30 l | 38° C. ± 0.3° C. | 45 |
| Bleaching-fixation (1) | 30 l | 38° C. ± 0.3° C. | — |
| Bleaching-fixation (2) | 30 l | 38° C. ± 0.3° C. | 39 |
| Rinse (1) | 10 | 33° C. ± 0.3° C. | — |
| Rinse (2) | 10 l | 33° C. ± 0.3° C. | 20 |
| Stabilization | 10 l | 38° C. ± 0.3° C. | 39 |

The bleaching-fixation and the rinsing steps were carried out in a countercurrent system, from the bleaching-fixation bath (2) to the bleaching-fixation bath (1) and from the rinsing bath (2) to the rinsing bath (1), respectively.

The composition of the original processing solutions in each tank and the replenisher added thereto is given below.

| | Original in Tank | Replenisher |
|---|---|---|
| Color developer: | | |
| Sodium nitrilo-triacetate | 1.0 g | 1.1 g |
| Sodium sulfite | 4.0 | 4.4 g |
| Sodium carbonate | 30.0 g | 32.0 g |
| Potassium bromide | 1.4 g | 0.7 g |
| Hydroxylamine sulfate | 2.4 g | 2.6 g |
| 4-(N—ethyl-N—β-hydroxy-ethylamino) 2-methyl-aniline sulfate | 4.5 g | 5.0 g |
| Water to make | 1 l | 1 l |
| pH | 10.00 | 10.05 |
| Bleaching-fixer solution: | | |
| Ammonium ethylenediamine-tetraacetate/ferric complex | 80.0 g | 90.0 g |

-continued

| | Original in Tank | Replenisher |
|---|---|---|
| Disodium ethylenediamine-tetraacetate-dihydrate | 5.0 g | 6.0 g |
| Sodium sulfite | 10.0 g | 15.0 g |
| Ammonium thiosulfate-aqueous solution (70%) | 250.0 g | 270.0 g |
| Bleaching-accelerator (III)-(3) | $1 \times 10^{-2}$ mole | $1.1 \times 10^{-2}$ mole |
| Water to make | 1 l | 1 l |
| pH | 7.0 | 6.8 |
| Rinsing solution: | | |
| Disodium ethylenediamine-tetraacetate-dihydrate | 0.4 g | 0.4 g |
| Water to make | 1.0 l | 1.0 l |
| pH | 7.0 | 7.0 |
| Stabilizer solution: | | |
| Formalin | 8.0 ml | 8.0 ml |
| Driwell (by Fuji Photo Film Co.) | 4.0 ml | 4.0 ml |
| Water to make | 1 l | 1 l |

According to the above-mentioned conditions, the color negative films were processed continuously for 60 days in an amount of 40 films a day. After the process, the tank solutions were removed from the bleaching-fixation baths (1) and (2) as fatigued in each of the steps (A), (B) and (C). Next, other films (HR400, as mentioned below) were processed in accordance with the step (I), (II) or (III) (as mentioned below), while the tank solutions which were removed from the bleaching-fixation baths were used and the processing time in the bleaching-fixation step (2) was varied (as shown in the following Table-5). After the above processing, the amount of silver which remained in the film was measured. The processing solutions and the processing steps in each of the steps (I), (II) and (III) are given in the Table-3 and Table-4 below. In this process, films of HR400 (by Fuji Photo Film Co.) having a coated silver amount of about 11g/m$^2$ were processed. These films had been imagewise exposed with a white light through an optical wedge. The amount of silver which remained in the part of maximum density in the films was measured by means of a fluorescent X-ray method.

TABLE 3

| Processing step | (I) | (II) | (III) |
|---|---|---|---|
| Color development | The above-mentioned color-developer (original tank solution) | | |
| Bleaching-fixation (1) | Tank solution (1) after step (A) | Tank solution (1) after step (B) | Tank solution (1) after step (C) |
| Bleaching-fixation (2) | Tank solution (2) after step (A) | Tank solution (2) after step (B) | Tank solution (2) after step (C) |
| Rinse | The above-mentioned rinsing solution (original tank solution) | | |
| Stabilization | The above-mentioned stabilizer solution (original tank solution) | | |

TABLE 4

| Processing Step | Time (I) | Time (II) | Time (III) | Temperature |
|---|---|---|---|---|
| Color development | 3'15" | | | 38° C. |
| Bleaching-fixation (1) | 4' | 2' | 1' | 38° C. |
| Bleaching-fixation (2) | As shown in Table 5 | | | 38° C. |
| Rinse | 4' | | | 33° C. |
| Stabilization | 40" | | | 38° C. |

The results are given in the following Table-5:

TABLE 5

| Processing time in bleaching-fixation bath (2) | Amount of remaining silver (μg/cm$^2$) (I) | (II) | (III) |
|---|---|---|---|
| 2' | 7.9 (comparative) | 7.4 (comparative) | 13.6 (comparative) |
| 3' | 6.3 (comparative) | 5.0 (present case) | 6.3 (comparative) |
| 4' | 5.8 (comparative) | 3.9 (present case) | 4.3 (present case) |
| 5' | 4.9 (present case) | 3.5 (present case) | 3.3 (present case) |
| 6' | 4.8 (present case) | 3.3 (present case) | 3.1 (present case) |
| 10' | 4.5 (present case) | 2.8 (present case) | 2.5 (present case) |

It is generally accepted that for color negative films the amount of silver remaining in the film must be 5 μg/cm$^2$ or less. From the above results, it can be seen that in continuous process (A) it was necessary to utilize a total processing time of 9 minutes, that is 4 minutes for bleaching-fixation (1) and 5 minutes for bleaching-fixation (2) (5 minutes), in order to achieve a remaining silver amount of less than 5 μg/cm$^2$. Referring specifically to process (I), it can be seen that to achieve suitable silver removal, the processing time for the bleaching-fixation (1) was 44% of the total bleaching-fixation processing time. On the other hand, it is noted that in each of the processes (B) and (C) (Refer to the process (II) or (III).) where the processing time for the bleaching-fixation step (1) was 2 minutes and 1 minute, respectively, it was sufficient to utilize a total bleaching-fixation processing time of 5 minutes. In each of these cases, however, the processing time for bleaching-fixation (1) was 40% and 20%, respectively, and the total processing time was somewhat longer than the time which is to be expected from the amount of coated silver in the film (11 g/m$^2$), the expected time being 4.07 minutes. It is further noted that in the process (A) where the processing time of 4 minutes for the bleaching-fixation (1) was relatively long, the remaining silver amount after the process step of the bleaching-fixation (2) did not decrease much below the amount of 5 μg/cm$^2$ even though the processing time was substantially increased. This means that silver which is unbleached and unfixed as formed in process (A).

EXAMPLE 2

In the same manner as Example 1 with the exception that the ammonium ethylenediamine-tetraacetate/ferric complex in the bleaching-fixation solution was replaced with ammonium diethylenetriaminepentaacetate/ferric complex, exposed films were processed, tested, and the results as shown in Table-6 below were obtained.

TABLE 6

| Processing time in bleaching-fixation bath (2) | Amount of remaining silver ($\mu g/cm^2$) (I) | (II) | (III) |
|---|---|---|---|
| 2' | 7.8 (comparative) | 7.3 (comparative) | 13.0 (comparative) |
| 3' | 6.3 (comparative) | 4.9 (present case) | 6.2 (comparative) |
| 4' | 5.6 (comparative) | 3.9 (present case) | 4.1 (present case) |
| 5' | 5.0 (present case) | 3.4 (present case) | 3.3 (present case) |
| 6' | 4.8 (present case) | 3.0 (present case) | 3.0 (present case) |
| 10' | 4.4 (present case) | 2.7 (present case) | 2.5 (present case) |

From the above results, the effect of the present invention is apparent. According to the method of the present invention, the amount of the replenisher in each step may be small and an extremely short period of time is sufficient for desilvering even in the processing of silver halide color photographic materials with a large amount of coated silver or with a high silver iodide content.

While the invention has been described in detail and with reference to specific embodiments thereof, it will be apparent to one skilled in the art that various changes and modifications can be made therein without departing from the spirit and scope thereof.

What is claimed is:

1. A method for processing a silverhalide color photograhic material comprising subjecting a silver halide photographic material to color development followed by bleaching-fixation, said bleaching-fixation including passing the photographic material through a first bleaching-fixation bath then to at least one additional bleaching-fixation bath each bleaching-fixation bath containing a solution with at least one bleaching agent and at least one fixing agent, while adding replenisher to at least one of the additional bleaching-fixation baths and counter-currently introducing overflow solution from at least one of the additional bleaching-fixation baths to a preceding bleaching-fixation bath, wherein subsequent to color development and prior to or simultaneously with the contact of the material with the bleaching agent the material is contacted with a bleach accelerating amount of at least one bleach accelerator, wherein the total time for bleaching-fixation is at least 0.37 minutes per $g/m^2$ of silver contained in the treated photographic material and wherein the processing time in the first bleaching-fixation bath is about 10 to about 40% of the total time for bleaching-fixation.

2. A method for processing a silver halide color photographic material as defined in claim 1 wherein the total bleaching-fixation processing time is 0.5 to 10 minutes.

3. A method for processing a silver halide color photographic material as defined in claim 1, wherein said at least one bleach accelerator is selected from the group consisting of formulae (I) to (IX)

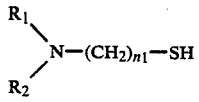

(I)

wherein $R_1$ and $R_2$ may be the same or different and each represent a hydrogen atom, a substituted or unsubstituted lower alkyl group; and $n_1$ is an integer of 1 to 3; or $R_1$ or $R_2$ may be bonded to each other to form a ring;

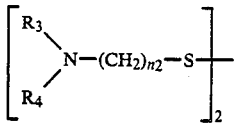

(II)

wherein $R_3$ and $R_4$ have the same meanings as $R_1$ and $R_2$ in the formula (I); and $n_2$ is an integer of 1 to 3; or $R_3$ and $R_4$ may be bonded to each other to form a ring;

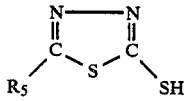

(III)

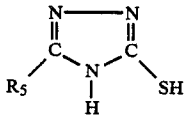

(IV)

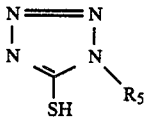

(V)

wherein $R_5$ represents a hydrogen atom, a halogen atom, an amino group, a substituted or unsubstituted lower alkyl group or an alkyl group-containing amino group;

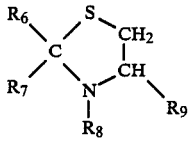

(VI)

wherein $R_6$ and $R_7$ may be the same or different and each are a hydrogen atom, an optionally substituted alkyl group, an optionally substituted phenyl group or an optionally substituted heterocyclic group;

$R_8$ represents a hydrogen atom or an optionally substituted lower alkyl group; and $R_9$ represents a hydrogen atom or a carboxyl group;

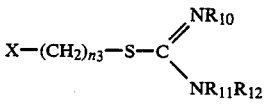

(VII)

wherein $R_{10}$, $R_{11}$ and $R_{12}$ may be same or different and each represent a hydrogen atom or a lower alkyl group; $n_3$ is an integer of 1 to 4;

$R_{10}$ and $R_{11}$ or $R_{12}$ may be bonded to each other to form a ring; and X represents an amino group optionally having substituent(s) or an amino group, a sulfonic acid group or a carboxyl group;

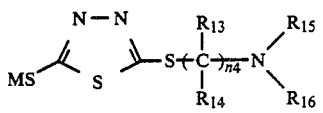

(VIII)

wherein $R_{13}$ and $R_{14}$ each represent a hydrogen atom, a hydroxyl group, a substituted or unsubstituted amino group, a carboxyl group, a sulfo group or a substituted or unsubstituted alkyl group; $R_{15}$ and $R_{16}$ each represent a hydrogen atom, a substituted or unsubstituted alkyl group or a substituted or unsubstituted acyl group; $R_{15}$ and $R_{16}$ may be bonded to each other to form a ring; M represents a hydrogen atom, an alkali metal atom or an ammonium group; and $n_4$ is an integer of from 2 to 5;

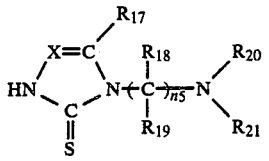

(IX)

wherein X represents N or C—R, and $n_5$ is an integer of from 0 to 5; R, $R_{17}$, $R_{18}$ and $R_{19}$ each represent a hydrogen atom, a halogen atom, an amino group, a hydroxyl group, a carboxyl group, a sulfo group or a substituted or unsubstituted alkyl group; and $R_{20}$ and $R_{21}$ each represent a hydrogen atom, a substituted or unsubstituted alkyl group or acyl group; or $R_{20}$ and $R_{21}$ may be bonded to each other to form a ring with the proviso that $R_{20}$ and $R_{21}$ are not both hydrogen atoms.

4. A method for processing a silver halide color photographic material as defined in claim 3 wherein the bleaching-accelerator is added to at least one of the bleaching-fixation baths.

5. A method for processing a silver halide color photographic material as defined in claim 3 wherein the bleaching-accelerator is added to a pre-bath and the photograhic material is treated in said pre-bath after color development but before bleachingfixation.

6. A method for processing a silver halide color photographic material as defined in claim 5 wherein the bleaching accelerator is also added to at least one of the bleaching-fixation baths.

7. A method for processing a silver halide color photographic material as defined in claim 3, wherein the bleaching-accelerator is selected from at least one of, compounds containing a mercapto group or a disulfide bond, thiazolidine derivatives, thiourea derivatives and isothiourea derivatives.

8. A method for processing a silver halide color photographic material as defined in claim 7 wherein the total time for bleaching-fixation is from 0.5 to 8 minutes.

9. A method for processing a silver halide color photographic material as defined in claim 1, wherein each bleaching-fixation solution contains 0.1 to 2 moles/liter of bleaching agent.

10. A method for processing a silver halide color photographic material as defined in claim 9, wherein the bleaching agent is a ferric complex bleaching agent and the pH of each bleaching-fixation solution is from 5.0 to 9.0.

11. A method for processing a silver halide color photographic material as defined in claim 10, wherein the pH of the bleaching-fixation solutions is from 4.0 to 8.5.

12. A method for processing a silver halide color photographic material as defined in claim 9, wherein the bleaching agent is a persulfate bleaching agent and the pH of the bleaching-fixation solutions is from 1 to 8.5.

13. A method for processing a silver halide color photographic material as defined in claim 1, wherein each bleaching-fixation solution contains 0.2 to 4 moles/liter of fixing agent.

14. A method for processing a silver halide color photographic material as defined in claim 1, wherein said silver halide is silver iodobromide or silver iodochlorobromide containing 30 mole % or less silver iodide.

15. A method for processing a silver halide color photographic material as defined in claim 1, wherein said silver halide is silver iodobromide containing 2 mole % to 25 mole % of silver iodide.

* * * * *